US006282386B1

(12) United States Patent
Ishii

(10) Patent No.: US 6,282,386 B1
(45) Date of Patent: Aug. 28, 2001

(54) TRANSFER-CONVEYANCE DEVICE AND METHOD CAPABLE OF CONTROLLING TRANSFER BIAS ACCORDING TO CHANGE IN ENVIRONMENTAL CONDITION

(75) Inventor: Hirokazu Ishii, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/505,144

(22) Filed: Feb. 15, 2000

(30) Foreign Application Priority Data

Feb. 15, 1999 (JP) ..... 11-036393

(51) Int. Cl.[7] ..... G03G 15/16; G03G 15/20
(52) U.S. Cl. ..... 399/66; 399/97; 399/297
(58) Field of Search ..... 399/44, 45, 46, 399/66, 97, 297, 302, 308, 313, 314, 316

(56) References Cited

U.S. PATENT DOCUMENTS

| | | | | |
|---|---|---|---|---|
| 5,461,461 | | 10/1995 | Harasawa et al. . | |
| 5,495,317 | | 2/1996 | Matsuda et al. . | |
| 5,515,146 | | 5/1996 | Harasawa et al. . | |
| 5,557,384 | | 9/1996 | Takano et al. . | |
| 5,623,330 | * | 4/1997 | Ishibashi | 399/310 |
| 5,631,725 | | 5/1997 | Harasawa et al. . | |
| 5,640,660 | | 6/1997 | Takano et al. . | |
| 5,659,843 | | 8/1997 | Takano et al. . | |
| 5,666,622 | | 9/1997 | Harasawa et al. . | |
| 5,682,575 | * | 10/1997 | Komori | 399/66 |
| 5,812,919 | | 9/1998 | Takano et al. . | |
| 5,822,667 | | 10/1998 | Hayama et al. . | |
| 5,887,220 | * | 3/1999 | Nagaoka | 399/46 |
| 5,897,241 | | 4/1999 | Takano et al. . | |
| 5,909,605 | * | 6/1999 | Nishizawa et al. | 399/66 |
| 5,930,573 | | 7/1999 | Miyamoto et al. . | |
| 5,978,617 | | 11/1999 | Takano et al. . | |
| 6,026,269 | * | 2/2000 | Setoriyama | 399/302 |

FOREIGN PATENT DOCUMENTS

| | | |
|---|---|---|
| 09006150 | 1/1997 | (JP) . |
| 10301408 | 11/1998 | (JP) . |

* cited by examiner

*Primary Examiner*—Arthur T. Grimley
*Assistant Examiner*—Hoang Ngo
(74) *Attorney, Agent, or Firm*—Oblon, Spivak, McClelland, Maier & Neustadt, P.C.

(57) ABSTRACT

A transfer-conveyance device for transferring a visible image on an image bearing member in an image forming apparatus onto a transfer sheet and to convey the transfer sheet. The transfer-conveyance device includes a contact member that contacts the image bearing member, a bias applying device to apply a transfer bias to the contact member, a resistance detecting device to detect a resistance of the contact member, and a transfer bias control device to determine an amount of variation in the resistance of the contact member and control the transfer bias. The transfer bias is controlled on the basis of the amount of variation in the resistance of the contact member. A method of controlling a transfer bias in an image forming apparatus includes the steps of applying the transfer bias to a contact member contacting an image bearing member to transfer an image on the image bearing member onto a transfer sheet, determining an amount of variation in a resistance of the transfer member, and controlling the transfer bias on the basis of the amount of variation in the resistance of the contact member.

24 Claims, 12 Drawing Sheets

AMOUNT OF VARIATION IN TRANSFER CURRENT BY A LAPSE OF TIME

TRANSFER-CONVEYANCE DEVICE AND METHOD CAPABLE OF CONTROLLING TRANSFER BIAS ACCORDING TO CHANGE IN ENVIRONMENTAL CONDITION

BACKGROUND OF THE INVENTION

1. Field of the Invention

The present invention relates to transfer-conveyance devices for use in image forming apparatuses, such as a copying machine, a printer, and a facsimile machine, and more particularly relates to transfer-conveyance devices controlling a transfer bias.

2. Discussion of the Background

In image forming apparatuses, such as copying machines, printers, facsimile machines, etc., using electrophotography, it is well known that a transfer-conveyance device transfers a visible toner image borne on an image bearing member (e.g., a photoconductor drum) onto a transfer sheet and conveys the transfer sheet toward a fixing device. It is also known that when transferring the toner image, a transfer bias is applied from a high voltage power source to a transfer belt or roller of the transfer-conveying device so as to pass through the transfer belt or roller to the photoconductor drum and that the transfer bias is controlled such that an optimum transfer is performed.

As the transfer bias control method, a "differential constant current control system" is known, in which a target current value of a transfer bias is predetermined and an output current value of the high voltage power source is controlled such that the current of the transfer bias passing through the transfer belt or roller to the photoconductor drum becomes the target current value by detecting a feedback current that is fed back to the high voltage power source.

However, optimum target current value of the transfer bias varies according to the parameters of the outside, i.e., the environmental condition, such as temperature and humidity condition, the lapse of time from a start of using the transfer belt and other factors. Therefore, in order to accomplish an optimum transfer, it is ideal to change the target current value of the transfer bias to the optimum target value according to the change in the parameters of the outside.

The target current value of the transfer bias cannot be changed only according to the change in the parameter of the outside, e.g., the temperature and humidity condition, because the resistance of the transfer belt or roller may have greatly changed according to the change in the temperature and humidity condition. For detecting the resistance of the transfer belt or the roller, a certain voltage needs to be applied to the transfer belt or the roller, which may result in interrupting a transfer operation, and thereby the productivity of the image forming apparatus may be decreased. Therefore, in background transfer-conveyance devices, the temperature and humidity condition and the resistance of a transfer belt or roller are detected at a relatively long interval, such as for example, every 6 hours or 12 hours. Accordingly, when the transfer belt or the transfer roller is made of material whose resistance greatly varies according to the change in the environmental condition, for example, if the temperature and humidity condition abruptly changes in such an interval of detecting the temperature and humidity condition and resistance of the transfer belt and changing the target current of the transfer bias, the transfer bias is controlled according to the target current value before the temperature and humidity condition changes and thereby an optimum transfer cannot be performed. For example, when an ionic conductor, whose resistance greatly changes according to a variation in the environmental condition, is used in the transfer belt or roller, and when the environmental condition changes from a high temperature and high humidity condition (hereinafter, referred to as a H/H condition) to a low temperature and low humidity condition (hereinafter referred to as a L/L condition), if the current of the transfer bias is controlled according to the target current value under the environmental condition of the H/H, an abnormal image may occur. On the contrary, when the environmental condition varies from a L/L condition to a H/H condition, if the current of the transfer bias is controlled according to the target current value under the environmental condition of the H/H, a lack of a transfer charge may occur, also resulting in the abnormal image. Furthermore, a good conveying performance for a transfer sheet, i.e., good performance to separate a transfer sheet from a photoconductor, is not obtained, and thereby, a sheet jamming may occur. Even if the sheet jamming does not occur, the sheet is separated from the photoconductor by a separation pick and as a result, a trace of a separation pick may remain in an image.

When material, whose resistance varies with a lapse of time, is used for the transfer belt or roller, a large variation in the resistance occurs in a relatively short time at an initial time of using the transfer belt or roller, such as for example when the transfer-conveyance device is new or when the transfer belt or roller is exchanged with a new one. Accordingly, the current of the transfer bias cannot be appropriately controlled at the initial time of using the transfer belt or roller.

SUMMARY OF THE INVENTION

The present invention has been made in view of the above discussed and other problems and addresses the above discussed and other problems. Preferred embodiments of the present invention provide a novel transfer-conveyance device and method capable of controlling the transfer bias even when the resistance of a transfer belt or roller of the transfer-conveyance device abruptly changes according to a variation of an environmental condition and a lapse of time.

According to the preferred embodiment of the present invention, a transfer-conveyance device to transfer a visible image on an image bearing member in an image forming apparatus onto a transfer sheet and to convey the transfer sheet includes a contact member that contacts the image bearing member, a bias applying device to apply a transfer bias to the contact member, a resistance detecting device to detect a resistance of the contact member, and a transfer bias control device to determine an amount of variation in the resistance of the contact member and control the transfer bias. The transfer bias is controlled on the basis of the amount of variation in the resistance of the contact member. The contact member of the transfer-conveyance device may be a transfer belt.

According to another preferred embodiment of the present invention, the transfer bias is controlled on the basis of the resistance of the contact member and the amount of variation in the resistance of the contact member.

According to still another embodiment of the present invention, the transfer-conveyance device further includes an environmental condition detecting device to detect an environmental condition, and the transfer bias is controlled on the basis of the amount of variation in the resistance of the contact member and the environmental condition.

According to another embodiment of the present invention, the transfer-conveyance device further includes a device to determine a lapse of time, and the transfer bias is controlled on the basis of the amount of variation in the resistance of the contact member and the lapse of time.

According to still another embodiment of the present invention, the transfer bias is controlled on the basis of the resistance of the contact member, the amount of variation in the resistance of the contact member and the environmental condition.

According to another embodiment of the present invention, the transfer bias is controlled on the basis of the resistance value of the contact member, the amount of variation in the resistance of the contact member and the lapse of time.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, in which:

FIG. 10 is a flowchart illustrating an example of an output transfer bias control process that is performed at an initial time when the power switch is turned on;

DESCRIPTION OF THE PREFERRED EMBODIMENTS

Figure 1:
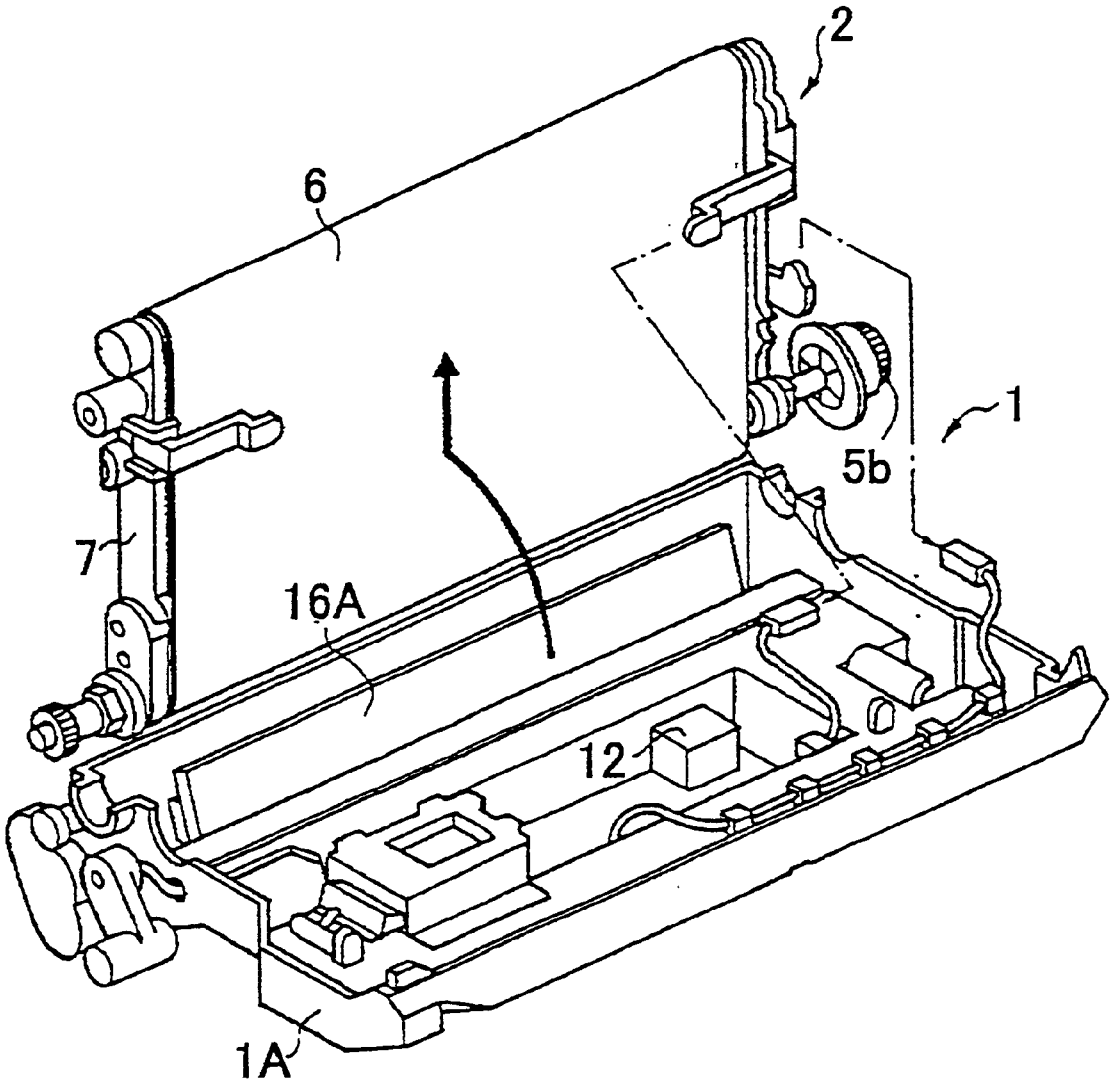
FIG. 1 is a perspective view illustrating a construction of a transfer-conveyance device of the present invention.

The preferred embodiments of the present invention are now described in detail referring to the drawings, wherein like reference numerals indicate identical or corresponding parts throughout the several views.

FIGS. 1 to 6 illustrate an example of a transfer-conveyance device in which the present invention is applied. A basic construction and an operation of the transfer-conveyance device are explained first and then a characteristic part of the present invention will be explained.

Figure 2:
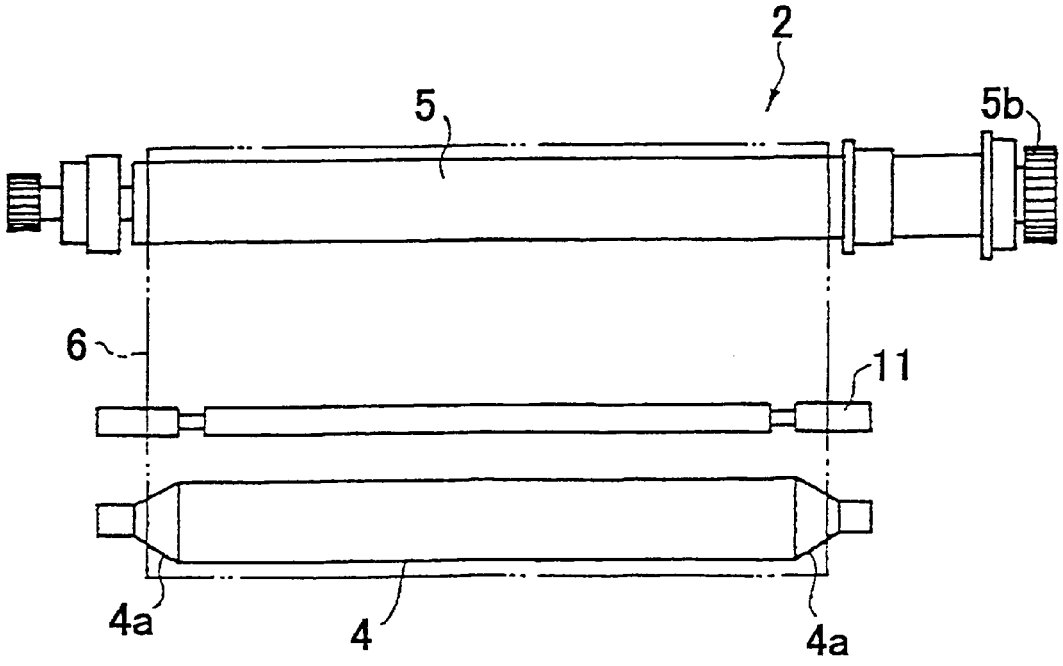
FIG. 2 is a plan view illustrating a construction of rollers of a belt unit of the transfer-conveyance device.
Figure 3:
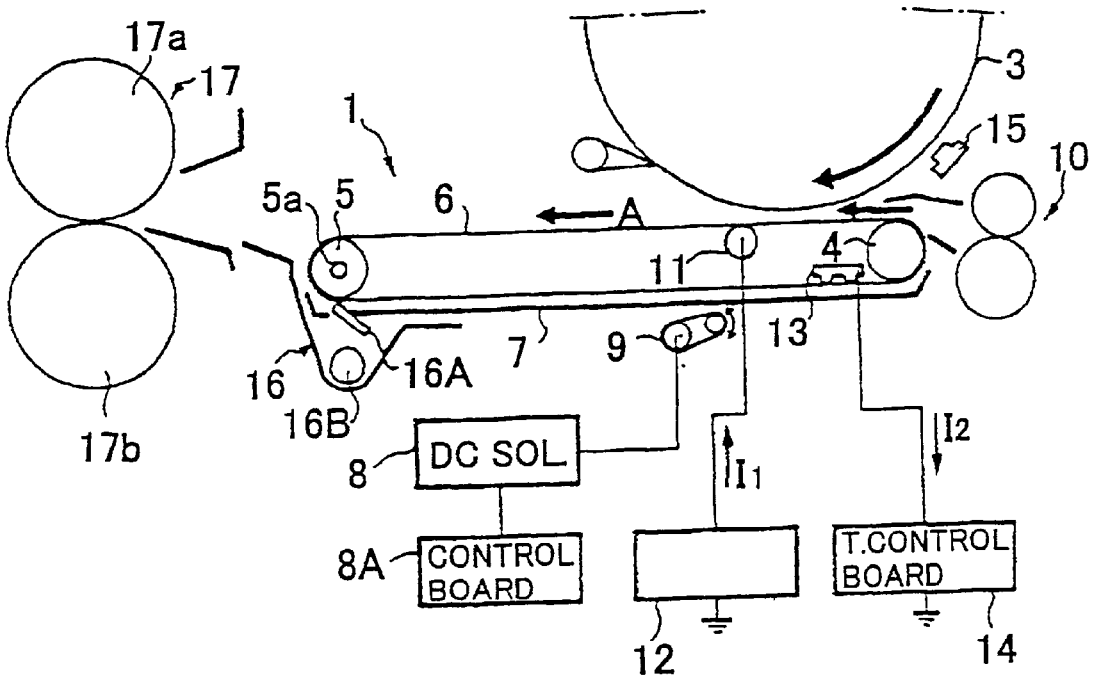
FIG. 3 is a schematic view illustrating the transfer-conveyance device provided in an image forming apparatus in which a transfer belt is separated from a photoconductor.
Figure 4:
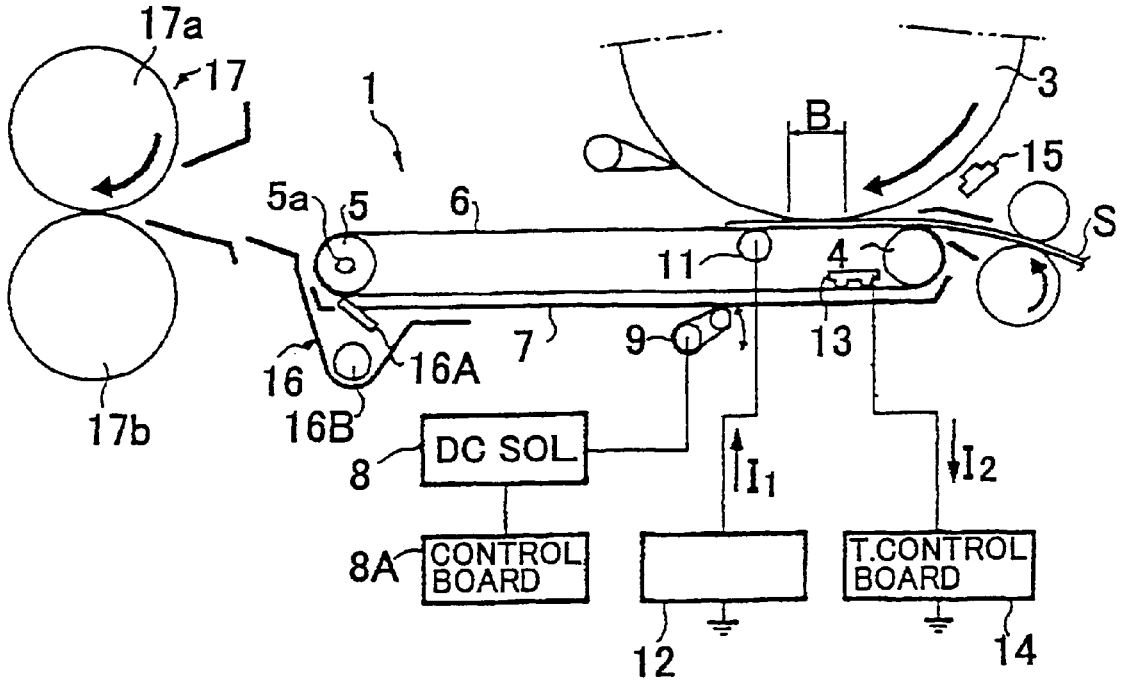
FIG. 4 is a schematic view illustrating the transfer-conveyance device provided in the image forming apparatus in which the transfer belt contacts the photoconductor nipping a transfer sheet with the photoconductor.

FIG. 1 illustrates a transfer-conveyance device 1 in which a belt unit 2 is separated from a main body 1A of the transfer-conveyance device 1. FIG. 2 is a plan view illustrating a construction of rollers of the belt unit 2. FIGS. 3 and 4 are side views illustrating the transfer-conveyance device 1 provided in an image forming apparatus, in which the device 1 is separated from a photoconductor drum 3 and in which device 1 contacts the photoconductor drum 3, respectively.

As illustrated in FIG. 1, the belt unit 2 is detachably supported by the main body 1A of the transfer-conveyance device 1. In the belt unit 2, a transfer belt 6 is stretched between a pair of rollers 4 and 5 illustrated in FIG. 2. Further, as illustrated in FIGS. 3 and 4, the transfer-conveyance device 1 includes a DC solenoid 8 and a contact/separate lever 9 to bring the transfer belt 6 in contact with or separate the transfer belt 6 from the photoconductor 3, a bias roller 11 to apply a transfer bias voltage to the transfer belt 6, and a contact plate 13 to electrically discharge a charge of the transfer belt 6. A toner image formed on the photoconductor drum 3 is transferred to a transfer sheet S by the transfer-conveyance device 1 as illustrated in FIG. 4. Furthermore, a cleaning device 16 having a cleaning blade 16A that scrapes off residual toner or paper dust adhering onto a surface of the transfer belt 6 therefrom and a high voltage power source 12 to apply a bias voltage to the bias roller 11 are provided in the main body 1A.

Figure 5:
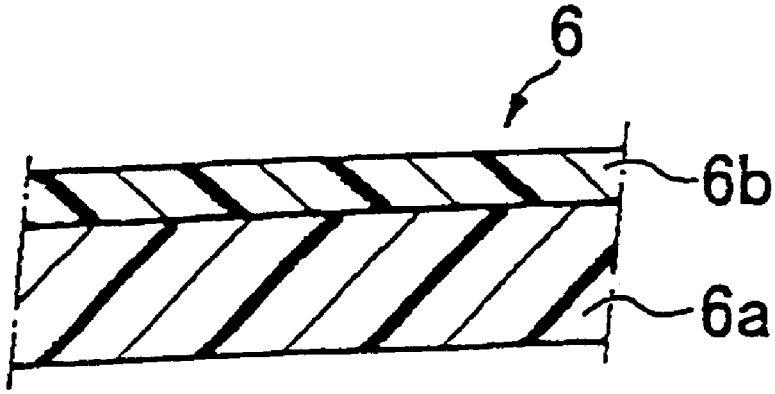
FIG. 5 is a partial cross section microscopically illustrating layers of the transfer belt of the transfer-conveyance device.

As illustrated in FIGS. 1 and 2, the roller 5 is provided with a gear 5*b* which is engaged with another gear of a drive motor (not shown) at an end of the roller shaft thereof, and is driven by the drive motor. The transfer belt 6 is driven by a rotation of the roller 5 and is configured to move in a conveying direction of the transfer sheet S (indicated by an arrow A in FIG. 3) at a position opposed to the photoconductor drum 3. The transfer belt 6 has a structure of two layers, as illustrated in FIG. 5, and when measured according to JIS K6911 upon application of DC 100V, the surface resistivity of the belt surface of the surface layer 6*b* as a thin coating layer having a low friction coefficient is set to from $1\times10^{8}\Omega$ to $1\times10^{12}\Omega$, and the surface resistivity of the inner surface layer 6*a* is set to from $1\times10^{7}\Omega$ to $1\times10^{9}\Omega$, and in addition, a volume resistivity of the transfer belt 6 is set to from $5\times10^{8}\Omega$cm to $5\times10^{10}\Omega$cm.

The pair of rollers 4 and 5 is rotatably supported by a supporting member 7 as illustrated in FIGS. 1 and 3. The supporting member 7 can swing around a supporting shaft 5*a* of the roller 5 as a fulcrum, which is positioned at a downstream side of the rotating transfer belt 6 from a transfer position of the transfer belt 6, which is opposed to the photoconductor drum 3 in a direction of conveying the transfer sheet S indicated by the arrow A, as illustrated in FIGS. 3 and 4. The DC solenoid 8 drives the contact/separate lever 9, which is connected to the DC solenoid 8, to raise or lower a side of the supporting member 7 near the transfer position of the transfer belt 6 according to a signal from a control board 8A, so as to bring the belt 6 in contact with the photoconductor drum 3 or separate the transfer belt 6 from the photoconductor drum 3.

The control board 8A generates a drive signal to drive the DC solenoid 8 when the transfer sheet S, which is conveyed by a pair of registration rollers 10 such that a leading edge of the transfer sheet S aligns with a leading edge of an image formed on the photoconductor drum 3, reaches a position close to the photoconductor drum 3. The supporting member 7 moves close to the photoconductor drum 3 and the transfer belt 6 contacts the photoconductor drum 3, by the driving operation of the solenoid 8. Thereby a transfer nip portion B is formed at a position on the transfer belt 6 opposite the photoconductor drum 3, as illustrated in FIG. 4. The transfer sheet S is conveyed through the transfer nip portion B due to contact with the photoconductor drum 3.

The roller 4, which is positioned at a photoconductor drum side of the transfer belt 6, is configured to be a driven roller while the roller 5 is configured to be a drive roller. As illustrated in FIG. 2, both ends 4*a* and 4*b* of the roller 4 are tapered so that the transfer belt 6 is prevented from being displaced in a direction of the shaft of roller 4. The roller 4 is made of conductive material, such as metal. However, FIGS. 2 and 3 illustrate an embodiment of the roller 4 that is configured to only support the transfer belt 6 having such resistance as described before, and the roller 4 is not electrically connected to other conductive members. Alternatively, the roller 4 may be grounded as the later described contact plate 13 and a current that passes through the roller 4 may be fed back to the high voltage power source 12.

The roller 5 as the drive roller is made of material having a high surface frictional resistance, such as EPD (ethylene-propylene-diene) rubber, chloroprene rubber, silicone rubber, or other rubber material to securely grip the transfer belt 6 when driving the transfer belt 6. Further, the roller 5 may be made of conductive material. When the roller 5 is made of conductive material, a current that passes through the roller 5 can be fed back to the high voltage power source 12.

The bias roller 11 is configured to contact an inner surface of the transfer belt 6 at a downstream side in a moving direction of the transfer belt 6 from the roller 4 (left side in FIGS. 3 and 4). The bias roller 11 is configured to be a contact electrode to apply a charge having a polarity opposite to the charged polarity of toner on the photoconductor drum 3 to the transfer belt 6, and is connected to the high voltage power source 12.

The contact plate 13 is located adjacent to the roller 4 contacting an inner surface of a part of the transfer belt 6 at the side of the supporting member 7. As described later, the contact plate 13 suppresses a charge given to the transfer sheet S at an upstream side of the transfer belt 6 in the moving direction of the transfer belt 6 from the transfer nip portion B. In addition, the contact plate 13 detects a current that passes through the transfer belt 6 as a feedback current to the high voltage power source 12, and a current of a transfer bias supplied from the bias roller 11 is controlled by a result of detection of the feedback current. Therefore, a transfer control board 14 is connected to the contact plate 13 to set a supply amount of current to the bias roller 11 according to a feedback current. The transfer control board 14 is also connected to the high voltage power source 12.

In the transfer-conveyance device 1, as illustrated in FIG. 4, the supporting member 7 is positioned to cause the transfer belt 6 to contact the photoconductor drum 3 in synchronism with a conveying operation for the transfer sheet S by the registration roller 10. As a result, the transfer nip portion B having a width of about from 4 to 8 mm in a direction of conveying the transfer sheet S is formed between the photoconductor drum 3 and the transfer belt 6.

Figure 6:
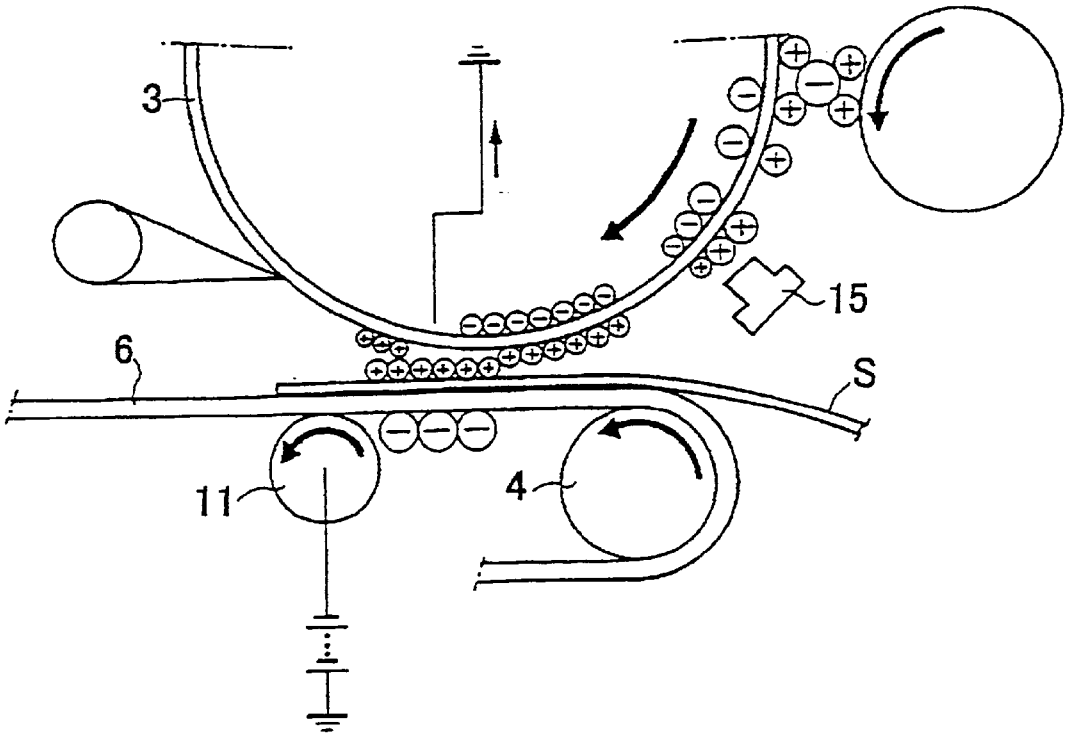
FIG. 6 is a representation illustrating a transfer function of the transfer-conveyance device.

On the other hand, as illustrated in FIG. 6, a surface of the photoconductor drum 3 having been charged at a surface potential of, for example, DC −800V, moves to the transfer nip portion B while electrostatically carrying toner having a plus charge. Then, the surface potential of the photoconductor drum 3 is decayed by a pre-transfer discharge lamp (PTL) 15, which is located adjacent to the photoconductor drum 3, before the charged surface reaches the transfer nip portion B. In FIG. 6, a size of circular marks represents an amount of electrostatic charge and the circular marks of a smaller size represent the electrostatic charge that is decayed by the pre-transfer discharge lamp 15.

In the transfer nip portion B illustrated in FIG. 4, the toner on the photoconductor drum 3 moves onto the transfer sheet S by a transfer bias voltage applied by the bias roller 11 that is located at the transfer belt 6 side. The transfer bias voltage is supplied by the high voltage power source 12 and is variably set in a range of from −1.5 to −6.5 KV according to a result of a below described differential constant current control operation. Namely, in FIGS. 3 and 4, when a value of current output from the high voltage power source 12 is $I_1$ and a detected value of the feedback current that passes through the contact plate 13 via the transfer belt 6 to a ground side is $I_2$, the current $I_1$ of the transfer bias is controlled such that the following equation is satisfied between both values:

$$I_1 - I_2 = I_{out} \quad (1)$$

where $I_{out}$ is constant. This control operation of the value of current $I_1$ prevents a fluctuation of the transfer efficiency by keeping a surface potential $V_P$ on the transfer sheet S constant regardless of variation in the environmental condition, such as a temperature and humidity, and variation in the manufacture quality of the transfer belt 6.

That is, the separation property or the transfer property for the transfer sheet S is prevented from being affected by keeping the current passing through the transfer belt 6 constant regardless of a change in the surface resistance of the transfer sheet S.

As an example, a good transfer performance was obtained when the current $I_{out}$ is set to 35 $\mu$A ±5 $\mu$A with the conveying speed for the transfer sheet S of 330 mm/sec and the effective bias roller length of 310 mm.

When an image is transferred from the photoconductor drum 3 to the transfer sheet S, the transfer sheet S is simultaneously charged. Accordingly, due to a relationship between a true electric charge on the transfer belt 6 and a polarization charge at a transfer sheet S, the transfer sheet S is electrostatically attracted onto the transfer belt 6, and thereby separated from the photoconductor drum 3.

The separating operation of the transfer sheet S is advanced by a self-peeling off operation of the transfer sheet S utilizing a curvature of the photoconductor drum 3 and the rigidity of the transfer sheet S.

However, when an environmental condition changes to a high humidity condition, such an electrostatic adhesion of the transfer sheet S to the transfer belt 6 is not sufficiently performed because a current tends to pass through the transfer sheet S under a high humidity condition. Therefore, a resistance value of the transfer belt 6 at the surface layer 6*b*, illustrated in FIG. 5, is set to a slightly larger value so as to delay a movement of the true electric charge from the transfer belt 6 to the transfer sheet S at the transfer nip portion B, and in addition, the bias roller 11 is located at a downstream side from the transfer nip portion B in a transfer sheet conveying direction. The movement of the true electric charge from the transfer belt 6 to the transfer sheet S is thereby delayed and electrostatic adhesion between the transfer sheet S and the photoconductor drum 3 is prevented. That is, the charge does not occur on the transfer sheet S at an upstream of the transfer nip portion B, i.e., before the transfer sheet S reaches the photoconductor drum 3. Consequently, the transfer sheet S is prevented from being insufficiently separated from the photoconductor drum 3.

Furthermore, as for the transfer belt 6, material having less variation in the resistance due to a variation in the environmental condition is preferable to be used, and as conductive material to control the resistance of the transfer belt 6, an appropriate amount of carbon, zinc oxide may be added to the transfer belt 6. In addition, when a rubber belt is used for the transfer belt 6 as an elastic belt member, chloroprene rubber, EPD rubber, epichlorohydrin rubber or like material having less hygroscopicity and stable resistance is desired to be used.

Furthermore, the value of the current $I_{out}$ that passes through the photoconductor drum 3 may be variable according to a conveying speed of the transfer sheet S. For example, when the conveying speed of the transfer sheet S is low, the current $I_{out}$ may be decreased. On the contrary, when the conveying speed of the transfer sheet S is high, or pre-transfer discharge lamp 15 is not used, the $I_{out}$ is increased.

The transfer sheet S that has passed through the transfer nip portion B is conveyed with the movement of the transfer belt 6 while being electrostatically attracted to the transfer belt 6, and then a curvature separation for the transfer sheet S is performed at the roller 5. To perfectly perform the curvature separation for the transfer sheet S, a diameter of the roller 5 is set to 16 mm or less. It has been proposed by an experiment that when the roller 5 has such a small diameter, a high-grade paper sheet having a thickness of 45 kg as defined in JIS and a lateral rigidity of 21 $cm^3/100$ can be separated from the transfer belt 6 at the roller 5.

The transfer sheet S separated from the transfer belt 6 at the roller 5 is conveyed between a heat roller 17*a* and a pressure roller 17*b* that form a fixing section 17, by being guided with a guide plate (not shown). In the fixing section 17, a toner on the transfer sheet S is melted by application of heat and fixed onto the transfer sheet S by pressure.

When the image transfer and separating operation of the transfer sheet S from the photoconductor drum 3 is completed, the transfer belt 6 is separated from the photoconductor drum 3 as the supporting member 7 is lowered by releasing the contact/separate lever 9 by turning off of the DC solenoid 8. Then, a cleaning device 16 cleans the surface of the transfer belt 6.

The cleaning device 16 includes a cleaning blade 16A, that is in sliding contact with the transfer belt 6 with friction so as to remove the toner that is transferred from a surface of the photoconductor drum 3 to the transfer belt 6, the toner scattered around the transfer belt 6, or paper powder of the transfer sheet S on the transfer belt 6.

Because the transfer belt 6 slidingly contacts the cleaning belt 16A, the transfer belt 6 is coated with fluorine-containing resins, such as for example polyvinylidene fluoride, tetra fluoethylene, or other material having low friction coefficient, so as to prevent increase of the force to drive the transfer belt 6 and a peeling off phenomenon of the cleaning blade 16A due to increase of the frictional resistance. In addition, the toner or the paper powder removed from a surface of the transfer belt 6 is conveyed by a toner re-claim screw 16B so as to be accommodated in a toner re-claim container (not shown).

A control of the transfer bias on the basis of an amount of variation in the resistance of a contact transfer member, i.e., a member that contacts a photoconductor in a contact type transfer-conveyance device, according to an embodiment of the present invention, is hereinbelow described.

In the embodiment, the amount of variation in the resistance of the transfer belt 6 is detected and when the detected amount of the variation in the resistance is equal to a predetermined value or less, the current of the transfer bias is controlled according to a variation in the environmental condition, i.e., a temperature and humidity condition in the image forming apparatus. When the detected amount of the variation in the resistance is larger than the predetermined value, the current of the transfer bias is controlled according to the variation in the resistance after the lapse of time.

First, a control of the current of the transfer bias according to the variation in the resistance of the transfer belt 6 and the variation in the environmental condition is described.

The amount of variation in the resistance of the transfer belt 6 is represented by a difference between a current value detected when a certain constant voltage is applied to the transfer belt 6 and a current detected after a certain time period, for example, one minute after the constant voltage is applied. Alternatively, the amount of variation in the resistance of the transfer belt 6 may be represented by an amount of variation in the voltage which is measured while applying a certain constant current. Further, the current value after the constant voltage application may be detected two or three minutes after the constant voltage is applied.

Figure 7:
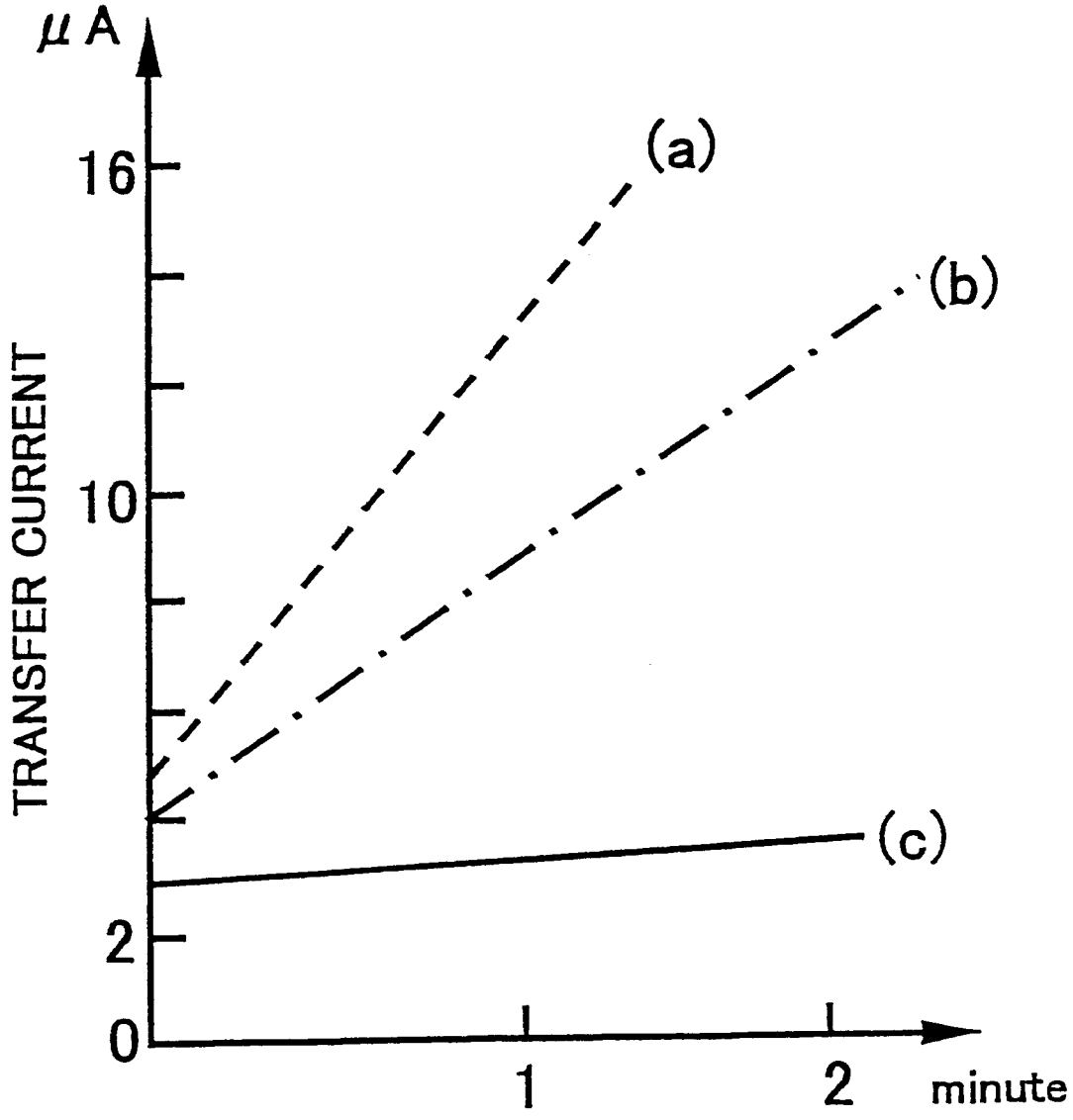
FIG. 7 is a graph illustrating an amount of variation in current that passes through three kinds of the transfer belts, respectively, substituting for an amount of variation in resistance of the three kinds of transfer belts, respectively.

FIG. 7 is a graph illustrating amounts of variation in the current that passes through typical examples of the transfer belt 6. The amount of variation in the current substitutes for an amount of variation in the resistance of the transfer belt 6. The examples (a), (b), and (c) of the transfer belt 6 have different resistance properties. As can be understood from the graph, the amount of variation in the current of the belt example (a) is larger than that of the belt example (c).

Further, as a property of the transfer belt 6, it is known that the larger the variation in the resistance of the transfer belt 6 with lapse of time is, the smaller the variation in the resistance of the transfer belt 6 caused by a variation in the environmental condition, such as a temperature and humidity condition around the belt, and vice versa.

The variation in the resistance of ionic conductors caused by a variation in the environmental condition is significantly larger than that of carbon-dispersed conductors. Therefore, it is difficult to control the current of the transfer bias according to the variation in the environmental condition when an ionic conductor is used for the transfer belt 6. However, the amount of the variation in the resistance of the ionic conductors with a lapse of time is extremely small.

On the other hand the variation in the resistance in carbon-dispersed conductors with a lapse of time is large and therefore the current of the transfer bias is hard to be appropriately controlled according to the lapse of time when the carbon-dispersed conductor is used for the transfer belt 6.

When the resistance of a transfer belt or a transfer roller is detected, a voltage having a value different from that applied to the transfer belt when performing a transfer operation, is applied thereto for detecting the resistance value, and therefore, the image forming operation must be stopped while detecting the resistance of the transfer belt. Accordingly, in a transfer operation in background art using a transfer belt made of ionic conductors, the current of the transfer bias controlled on the basis of the resistance value of the transfer belt is not constantly performed, i.e., the current control of the transfer bias is performed in certain intervals, such as for example, every six hours or every twelve hours.

Accordingly, when the environmental condition rapidly varies during the above interval, i.e., between the detection of the resistance value, the control operation for the current of the transfer bias cannot respond to the variation in the resistance value of the transfer belt 6, particularly, at an initial time after the power switch of the image forming apparatus is turned on, at which the resistance value of the transfer belt tends to rapidly vary when the ionic conductors are used for the transfer belt 6.

However, in this embodiment, when the amount of variation in the resistance of the transfer belt 6 is once detected, an appropriate transfer current is determined based upon a table in which an appropriate transfer current for each environmental condition is defined. Accordingly, even when a sudden change of the environmental condition occurs, the appropriate current of the transfer bias control can be immediately performed without performing detection of the resistance (current) of the transfer belt 6.

Table 1 indicates a relationship between the amount of variation in the resistance of the transfer belt 6 and the transfer current to be applied to the transfer belt 6 under three environmental conditions.

TABLE 1

| Amount of variation in resistance of the transfer belt 6 (μA) | Transfer current to be applied to the transfer belt 6 (μA) | | |
|---|---|---|---|
| | Under L/L environmental condition | Under N/N environmental condition | Under H/H environmental condition |
| 0.3 or less | 20 | 25 | 35 |
| More than 0.3, and 0.5 or less | 25 | 30 | 35 |
| More than 0.5, and less than 0.8 | 33 | 30 | 30 |
| .8 or more | 33 | 30 | 30 |

As can be understood from Table 1, the amount of variation in the resistance of the transfer belt 6 is divided into four ranges, and the environmental condition is divided into three conditions of L/L (low temperature, low humidity), N/N (normal temperature, normal humidity), and H/H (high temperature, high humidity).

According to Table 1, for example, when the amount of variation in the resistance (in this embodiment, a current value as substitution for the resistance value) of the transfer belt 6 is equal to 0.3 μA or less, under the environmental condition of L/L, the current of the transfer bias is controlled to be 20 μA, and when under environmental condition of H/H, the current of the transfer bias is controlled to be 35 μA. When the amount of variation in the resistance is 0.8 μA or more, under the environmental condition of L/L, the current of the transfer bias is controlled to be 33 μA, and when the environmental condition is N/N and H/H, the current of the transfer bias is controlled to be 30 μA.

A control of the current of the transfer bias is performed by a controller 30 of an image forming apparatus in which the transfer-conveyance device 1 is mounted. An exemplary construction of the controller 30 is illustrated in FIG. 8.

Figure 8:
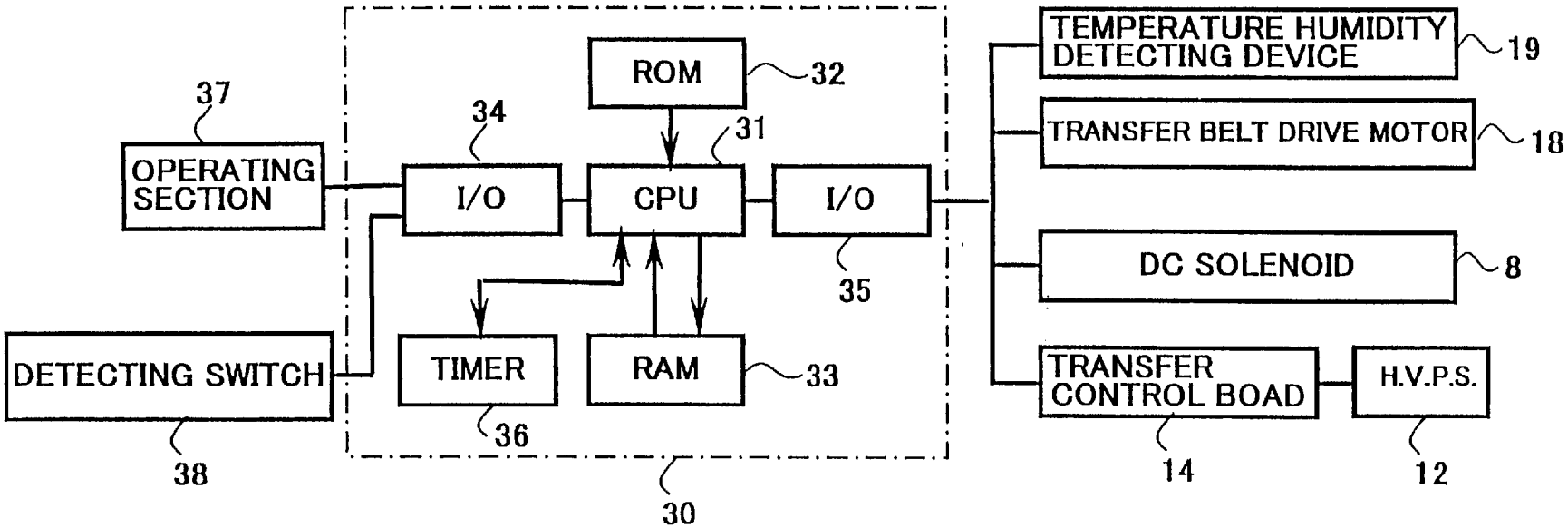
FIG. 8 is a block diagram illustrating a construction of a controller that performs a transfer bias control of an embodiment of the present invention.

In a block diagram in FIG. 8, the controller 30 includes a ROM 32, a RAM 33, I/O interfaces 34 and 35, a timer 36. To the I/O interface 34, an operating section (operation panel) 37 of the image forming apparatus and a detecting switch 38 provided in a manual sheet-feeding unit are connected. To the I/O interface 35, the DC solenoid 8 of the transfer-conveyance device 1, a transfer belt drive motor 18, the high voltage power source 12 via the transfer control board 14, a temperature-humidity detecting device 19 are connected.

Table 1 is stored in the ROM 32 of the controller 30 , and as described later, when the amount of variation in the resistance of the transfer belt 6 is once detected, the CPU 31 reads out an appropriate current value from Table 1 according to a value detected by the temperature-humidity detecting device 19 and outputs a control signal to the transfer control board 14 so as to control the high voltage power source 12. Thus, the transfer current is changed according to a variation in the environmental condition and thereby an appropriate transfer current can be applied to the transfer belt 6 even when a sudden variation in the environmental condition occurs.

That is, the above current control operation for the transfer bias is advantageous, in particular, in the environment where fluctuations of the environmental condition suddenly occur.

Further, although Table 1 indicates a relationship between the amount of variation in the resistance of the transfer belt 6 and the transfer current to be applied to the transfer belt 6 under three environmental conditions, where the transfer belt 6 has a normal resistance, the table may be made with different resistances of the transfer belt 6 as indicated in Table 2. In Table 2, the resistance values of the transfer belt 6 are divided into four ranges of "super low", "low", "medium", and "high".

TABLE 2

| Amount of variation in resistance (current) of the transfer belt 6 (μA) | Transfer current to be applied to the transfer belt 6 (μA) | | | | | | | | | | | |
|---|---|---|---|---|---|---|---|---|---|---|---|---|
| | Under L/L environmental condition | | | | Under N/N environmental condition | | | | Under H/H environmental condition | | | |
| | SL | L | M | H | SL | L | M | H | SL | L | M | H |
| 0.3 or less | 25 | 20 | 20 | 20 | 25 | 25 | 25 | 20 | 37 | 35 | 35 | 25 |
| More than 0.3, and 0.5 or less | 30 | 25 | 25 | 20 | 30 | 30 | 30 | 20 | 37 | 35 | 35 | 30 |
| More than 0.5, and less than 0.8 | 35 | 33 | 33 | 30 | 33 | 30 | 30 | 25 | 35 | 30 | 30 | 25 |
| 0.8 or more | 37 | 33 | 33 | 30 | 33 | 30 | 30 | 25 | 35 | 30 | 30 | 30 |

In Table 2, SL represents Super Low transfer belt having the resistance of less than $10^7\Omega$, L represents Low 5 transfer belt 6 having the resistance of from $10^7\Omega$ to less than $10^8\Omega$, M represents Medium transfer belt 6 having the resistance of from $10^8\Omega$ to less than $10^9\Omega$, and H represents the resistance of $10^9\Omega$ to less than $10^{10}\Omega$.

Each resistance value is detected by a transfer belt resistance detecting process described later. A smoother control of the current of the transfer bias can be performed by using Table 2. The Low transfer belt 6 and Medium transfer belt 6 correspond to the transfer belt 6 having a normal resistance and the resistance values in columns of L and M in Table 2 are identical to those of Table 1.

Next, a current control of the transfer bias according to the amount of variation in the resistance of the transfer belt 6 and a variation in the resistance with a lapse of time will be described. This current control operation of the transfer bias is advantageous, in particular, when a carbon-dispersed conductor is used for the transfer belt 6, in which the variation in the resistance with lapse of time is larger than that caused by a variation in the environmental condition, because the current control of the transfer bias must be performed on the basis of the lapse of time.

Figure 9:
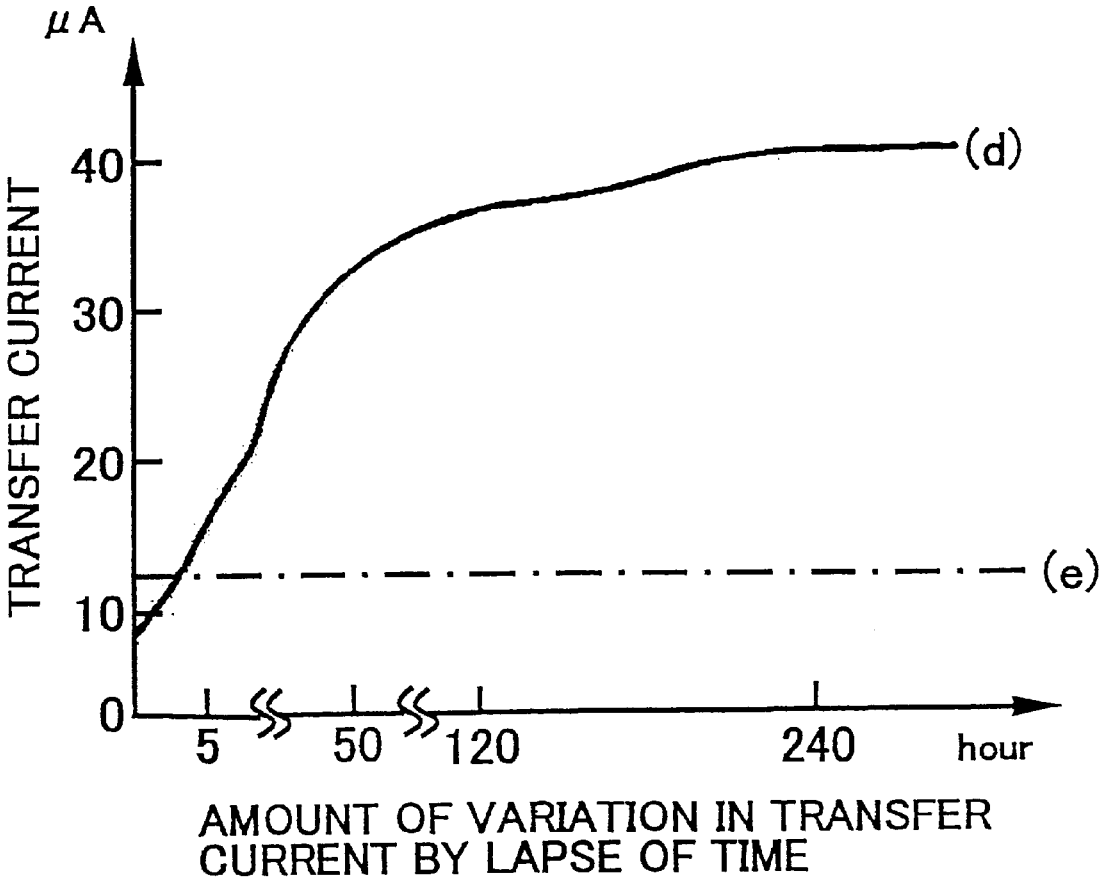
FIG. 9 is a graph illustrating a relationship between a current that passes through the transfer belt and a lapse of time for two belts, substituting the current for resistance.

FIG. 9 is a graph illustrating a variation of the current value that passes through the transfer belt 6, substituting for a variation of the resistance with the lapse of time. In FIG. 9, the variation of a current in an example (d) of the transfer belt 6 made of a carbon-dispersed conductor and that of an example (e) of the transfer belt 6 made of an ionic conductor are indicated. As can be understood from the graph, the amount of variation in the resistance of the example (d) made of a carbon-dispersed conductor with the lapse of time is larger than that of the belt example (e) made of an ionic conductor.

Table 3 indicates a relationship between the amount of variation in the resistance of the transfer belt 6 and the transfer current to be applied to the transfer belt 6 after five steps of lapse of time, i.e., 5, 12, 24, 120, and 240 hours, when a belt having a resistance of from $10^8$ to $10^9\Omega$ is used.

TABLE 3

| Amount of variation in resistance | Transfer current to be applied to the transfer belt 6 (μA) | | | | |
|---|---|---|---|---|---|
| (current) of the transfer belt 6 (μA) | Lapse of 5 hours | Lapse of 12 hours | Lapse of 24 hours | Lapse of 120 hours | Lapse of 240 hours |
| 0.3 or less | 25 | 25 | 25 | 25 | 25 |
| More than 0.3, and 0.5 or less | 30 | 30 | 30 | 30 | 30 |
| More than 0.5, and less than 0.8 | 30 | 33 | 35 | 35 | 37 |
| 0.8 or more | 30 | 35 | 37 | 37 | 37 |

As indicated in Table 3, the amount of variation in the resistance (current) of the transfer belt 6 is divided into four ranges.

The data of Table 3 is also stored in the ROM 32 of the controller 30. The CPU 31 controls the current of the transfer bias according to the amount of variation in the current that passes through the transfer belt 6 substituting for the amount of variation in the resistance of the transfer belt 6, which is previously detected, and the lapse of time on the basis of the data in Table 3.

For example, in Table 3, the current of the transfer bias is controlled such that when the detected amount of variation in the current of the transfer belt 6 is 0.8 μA or more, when the lapse of time is 5 hours or less, the current of the transfer bias is controlled to be 30 μA, when the lapse of time is more than 5 hours and 12 hours or less, the current of the transfer bias is controlled to be 35 μA, and when the lapse of time is more than 24 hours, the current of the transfer bias is controlled to be 37 μA.

In the transfer belt 6, the variation in the resistance is not only caused by a change in the property of material but also caused by an elongation of the transfer belt 6 as a result of being stretched. Because the elongation of the transfer belt 6 is highly dependent on a lapse of time, when a table defining a relationship between the amount of variation in the resistance of the transfer belt 6 and the transfer current to be applied to the transfer belt 6 is configured so as to include control values for the current of the transfer bias reflecting a variation in the resistance caused by the elongation of the transfer belt 6, a current control of the transfer bias can be accurately performed even when a member having an elongation property is used for the transfer belt 6.

Further, Table 3 indicates a relationship between the amount of variation in the resistance of the transfer belt 6 and the transfer current to be applied to the transfer belt 6 when the transfer belt 6 has a normal resistance value. For the purpose of covering a wider range of resistance values of the transfer belt 6, separate tables to indicate separate ranges of the resistance values of the transfer belt 6 may be prepared, for example, as tables 4, 5, and 6. Tables 4, 5, and 6 indicate relationship between the amount of variation in the resistance of the transfer belt 6 and the transfer current to be applied to the transfer belt 6 when the transfer belt has a resistance value of less than $10^7\Omega$ (Table 4), when the transfer belt has a resistance value of from $10^7\Omega$ to less than $10^9\Omega$ (Table 5), and when the transfer belt has a resistance value of $10^9\Omega$ to less than $10^{10}\Omega$ (Table 6), respectively. The tables 4, 5, and 6 are prepared to cover the resistance values of less than $10^7\Omega$ (super low resistance), from $10^7\Omega$ to less than $10^9\Omega$ (low and medium resistance), and from $10^9\Omega$ to less than $10^1\Omega^0$ (high resistance), respectively.

Any one of tables 4 to 6 can be used according to the resistance value of the transfer belt 6, which is detected as described later, to control the current of the transfer bias. In addition, the current control data of the transfer bias of Table 5 is identical with that of Table 3.

TABLE 4

| Amount of variation in resistance | Transfer current to be applied to the transfer belt 6 (μA) | | | | |
|---|---|---|---|---|---|
| (current) of the transfer belt 6 (μA) | Lapse of 5 hours | Lapse of 12 hours | Lapse of 24 hours | Lapse of 120 hours | Lapse of 240 hours |
| 0.3 or less | 28 | 28 | 28 | 28 | 28 |
| More than 0.3, and 0.5 or less | 32 | 32 | 32 | 32 | 32 |
| More than 0.5, and less than 0.8 | 32 | 34 | 37 | 37 | 39 |
| 0.8 or more | 32 | 36 | 39 | 39 | 40 |

TABLE 5

| Amount of variation in resistance | Transfer current to be applied to the transfer belt 6 (μA) | | | | |
|---|---|---|---|---|---|
| (current) of the transfer belt 6 (μA) | Lapse of 5 hours | Lapse of 12 hours | Lapse of 24 hours | Lapse of 120 hours | Lapse of 240 hours |
| 0.3 or less | 25 | 25 | 25 | 25 | 25 |
| More than 0.3, and 0.5 or less | 30 | 30 | 30 | 30 | 30 |
| More than 0.5, and less than 0.8 | 30 | 33 | 35 | 35 | 37 |
| 0.8 or more | 30 | 35 | 37 | 37 | 37 |

TABLE 6

| Amount of variation in resistance | Transfer current to be applied to the transfer belt 6 (μA) | | | | |
|---|---|---|---|---|---|
| (current) of the transfer belt 6 (μA) | Lapse of 5 hours | Lapse of 12 hours | Lapse of 24 hours | Lapse of 120 hours | Lapse of 240 hours |
| 0.3 or less | 23 | 23 | 23 | 23 | 23 |
| More than 0.3, and 0.5 or less | 28 | 28 | 28 | 28 | 28 |

TABLE 6-continued

| Amount of variation in resistance (current) of the transfer belt 6 (μA) | Transfer current to be applied to the transfer belt 6 (μA) | | | | |
|---|---|---|---|---|---|
| | Lapse of 5 hours | Lapse of 12 hours | Lapse of 24 hours | Lapse of 120 hours | Lapse of 240 hours |
| More than 0.5, and less than 0.8 | 28 | 30 | 32 | 32 | 32 |
| 0.8 or more | 28 | 30 | 32 | 35 | 35 |

The above described Tables 4 to 6 are also stored in the ROM 32 in FIG. 8.

Figure 10:
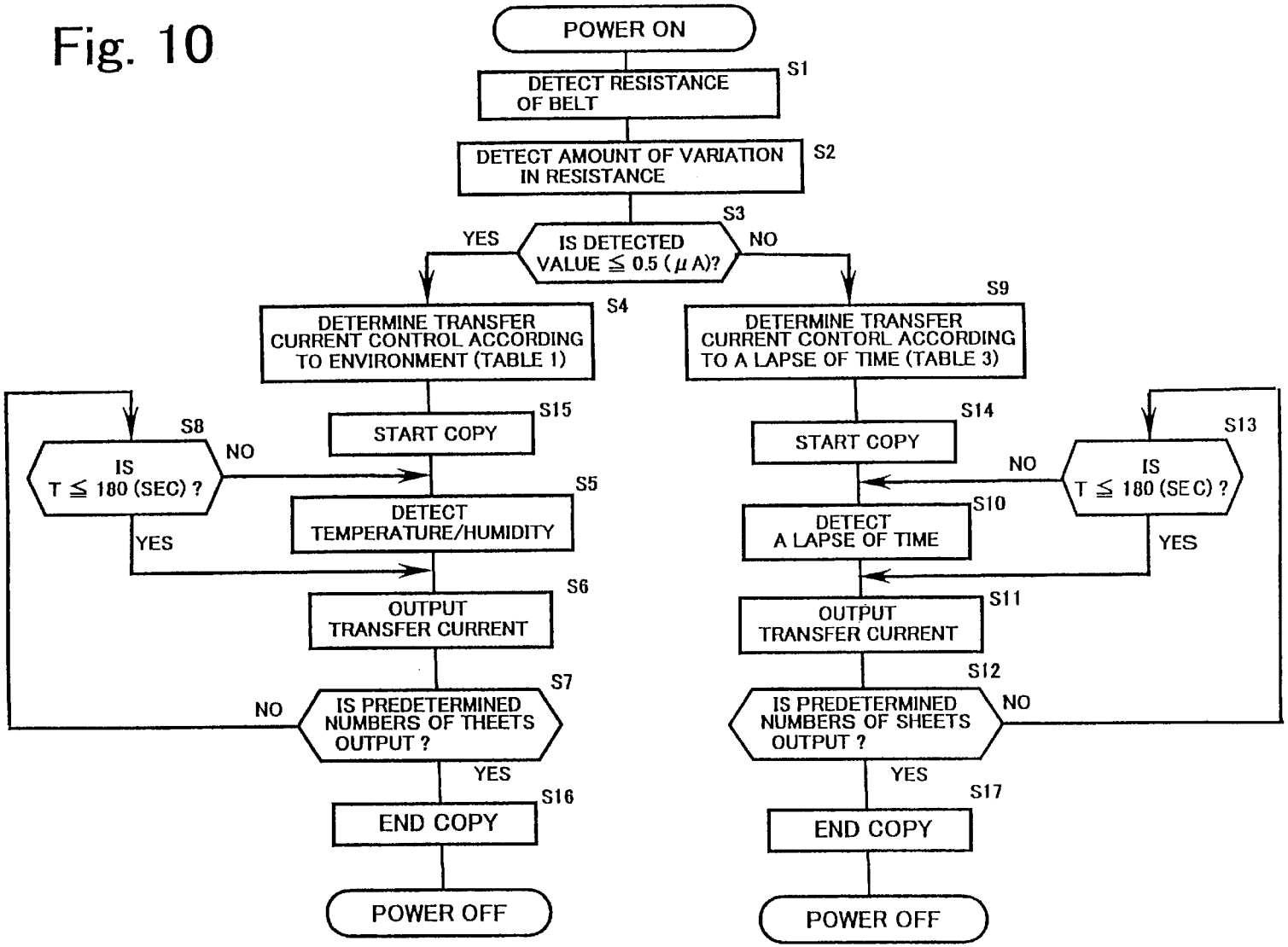

Next, an example of a control of the transfer bias of the present invention is described referring to a flowchart in FIG. 10. Although only a current control of the transfer bias is described, a voltage of the transfer bias may be controlled in a similar manner.

As described before, "the amount of variation in the resistance" is substituted by "amount of variation in current".

In the flowchart in FIG. 10, first, a resistance of the transfer belt 6 is detected by a procedure, described later (Step S1). Then, an amount of variation in the resistance of the transfer belt 6 is detected (Step S2). When the detected value of amount of variation in resistance is judged to be 0.5 (μA) or less (YES in Step S3), the controller 30 determines to perform the current control of the transfer bias according to a change in the environmental condition using Table 1 (or 2, as described before) (Step S4). When the detected value of amount of variation in the resistance is judged to be more than 0.5 (NO in Step S3), the controller determines to perform the current control of the transfer bias according to a change in the lapse of time using Table 4 (5 or 6, as described before)(Step S9).

When the operation proceeds from Step S3 to Step S4, after the controller determines to perform the current control of the transfer bias according to a variation in the environmental condition, a copying operation is started in Step S15, and an environmental condition (temperature and humidity) is detected (Step S5). The controller 30 then reads out the transfer current value of the transfer bias that is appropriate for the environmental condition from Tables 1 or 2 and outputs the transfer current value (Step S6). The controller 30 judges whether a predetermined number of copied sheet is output (Step S7). When the answer is NO, the controller 30 judges whether a time T (an elapsed time after copying operation has started) is smaller than 180 second (Step S8). When the time T is smaller than 180 second (YES in Step S8), the controller 30 keeps outputting the same transfer current value (Steps S6) and repeat the process of Steps S6, 7 and 8 until the time T exceeds 180 second. The 180 second of the time T is an example. When the time T is larger than 180 second (NO in Step S8), the controller 30 again detects the environmental condition (Step S5), and then outputs the transfer current based on the resultant value of the environmental condition (Step S6). When the predetermined number of sheets is output (YES in Step S7), the controller 30 ends the copying operation (STEP S16).

When the operation proceeds from Step S3 to S9, after the controller 30 determines to control the current of the transfer bias according to the lapse of time, the copying operation is started (Step S14). Then, the controller 30 starts a detection of lapse of time (Step S10), and outputs the transfer current value by reading out an appropriate transfer current value from Tables 3, 4, or 5 as described before (Step S11). The controller judges whether the predetermined numbers of sheets are output (Step S12). If the answer is NO in Step S12, the controller judges whether the time T has reached 180 second from the copying operation has started (Step S13). When the time T has not reached 180 second, the controller keeps outputting the same current value of the transfer bias (Step S11), and repeats the process through Steps 12, and 13 until the time T exceeds 180 second. When the time T exceeds 180 second, the controller 30 again detects the lapse of time (Step S10), and then outputs the transfer current based on the resultant value of the lapse of time as described before (Step S11). When the predetermined numbers of sheets are output (YES in Step S12), the controller 30 ends the copying operation (Step S17).

Thus, in the transfer-conveyance device of the present invention, because the amount of variation in the resistance of the transfer belt 6 is detected and the current of the transfer bias is controlled according to the resultant detected value, according to either the environmental condition or the lapse of time, an appropriate current control of the transfer bias corresponding to a property of the material of the transfer belt 6 can be performed. Therefore, when the transfer-conveying device uses an ionic conductor, the current of the transfer bias of the transfer-conveyance device can be further accurately controlled, resulting in realizing an optimum transfer operation according to the environmental condition, and when the transfer-conveyance device uses a carbon-dispersed conductor, the transfer current of the transfer-conveyance device can be further accurately controlled, resulting in realizing an optimum transfer operation according to the lapse of time.

Further, when the detected resistance value of the transfer belt 6 is used to control the current of the transfer bias in addition to the amount of variation in the resistance of the transfer belt 6, i.e., when Table 2 is used in replacement to Table 1, and when either Table 4 or Table 5 is used in replacement to Table 3, the control of the current of the transfer bias can be performed corresponding to the property of the material and the resistance of the transfer belt 6, and a further appropriate transfer operation can be realized.

Figure 11:
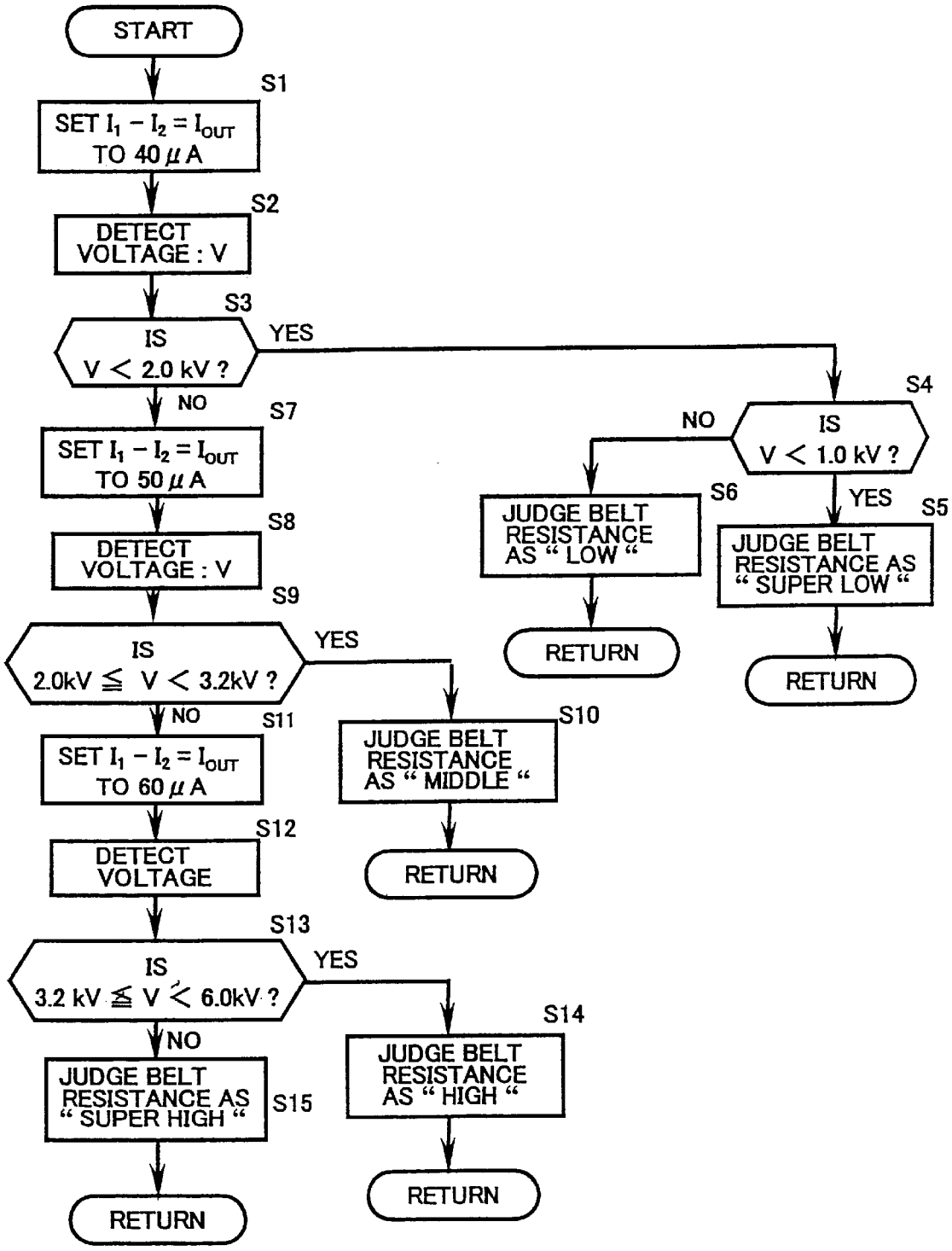
FIG. 11 is a flowchart illustrating a process of detecting a value of resistance of the transfer belt.

FIG. 11 illustrates an example of a process to detect the resistance of the transfer belt 6 corresponding to Step S1 of the flowchart in FIG. 10. In this example, the resistance of the transfer belt 6 is calculated on the basis of a voltage value under application of a predetermined constant current to the transfer belt 6. Although the calculated resistance value does not precisely represent the volume resistivity of the transfer belt 6, the calculated resistance value can be used as the volume resistivity of the transfer belt 6. Further, the resistance of the transfer belt 6 can be detected by other method such as detecting a current value that passes through the transfer belt 6 on application of a constant voltage.

In the flowchart in FIG. 11, the current $I_{out}$, which is a difference between the output current $I_1$ from the high voltage power source 12 and the feedback current $I_2$ that passes through the contact plate 13 (FIG. 3), is set to 40 μA and the current $I_{out}$ is applied to the transfer belt 6 from the bias roller 11 (Step S1). A voltage value V is detected (Step S2) and whether the voltage value V is less than 2.0 kV is judged (Step S3). When the voltage value is less than 2.0 kV (YES in Step S3), the controller 30 further judges whether the voltage value is less than 1.0 kV (Step S4). When the voltage value is less than 1.0 kV, the controller judges the resistance value of the transfer belt to be "super low" (Step S5), then the program returns, and when the voltage value V is not less than 1.0 kV (NO in Step S4), the controller 30 judges the resistance value of the belt to be "low" (Step S6) and then the program returns.

When the voltage value V is 2.0 kV or larger (NO in Step S3), the controller 30 sets the current $I_{out}$ to 50 $\mu$A and applies the current $I_{out}$ to the transfer belt 6 (Step S7). The controller 30 then detects the voltage value V again (Step S8). The controller 30 judges whether the voltage value V is 2.0 kV or larger and less than 3.2 kV (Step S9). When the voltage value V is judged to be 2.0 kV or larger and less than 3.2 kV (YES in Step S10), the controller 30 judges the resistance of the transfer belt 6 to be "medium".

When the voltage value V is 3.2 kV or larger (NO in Step S9), the controller 30 set the current $I_{out}$ to 60 $\mu$A and applies the current $I_{out}$ to the transfer belt 6 (Step S11). The controller 30 then detects the voltage value V again (Step S12). The controller 30 judges whether the voltage value V is 3.2 KV or larger and less than 6.0 kV (Step S13). When the voltage value V is 3.2 KV or larger and less than 6.0 kV (YES in Step S13), the controller 30 judges the resistance value of the transfer belt 6 to be "high" (Step S14) and the program returns. Further, when the voltage value V is 6.0 kV or larger (NO in Step S13), the controller 30 judges the resistance value of the transfer belt 6 to be "super high" (Step S15) and the program returns.

When the detected amount of variation in the resistance of the transfer belt 6 is 0.5 $\mu$A (substituted by an amount of the variation in the current) or less, the environmental condition is L/L (low temperature and low humidity), and the resistance of the transfer belt 6 is judged to be "super high", if the current of the transfer bias is controlled by a transfer current control system, an output voltage from the high voltage power source 12 may be abnormally increased and a leakage from the transfer belt 6 to the photoconductor drum 3 may occur. Therefore, in such a case the control is switched from a "differential constant current control system" to a "constant voltage control system".

The transfer voltage differs depending on a contact transfer system, when a transfer belt is used, the transfer voltage is preferable to be from about 6.3 kV to about 6.8 kV.

When the amount of variation in the resistance (current) is 0.5 $\mu$A or more and the resistance of the transfer belt 6 is judged to be "super high", the resistance of the transfer belt 6 tends to be high in an initial time of using the transfer belt 6, and is decreased along with a lapse of time. Consequently, the leakage from the transfer belt 6 to the photoconductor drum tends to occur in the initial time of using the transfer belt 6. Therefore, in such a case, the control is also switched from the differential constant current control system to the constant voltage control system.

Figure 12:
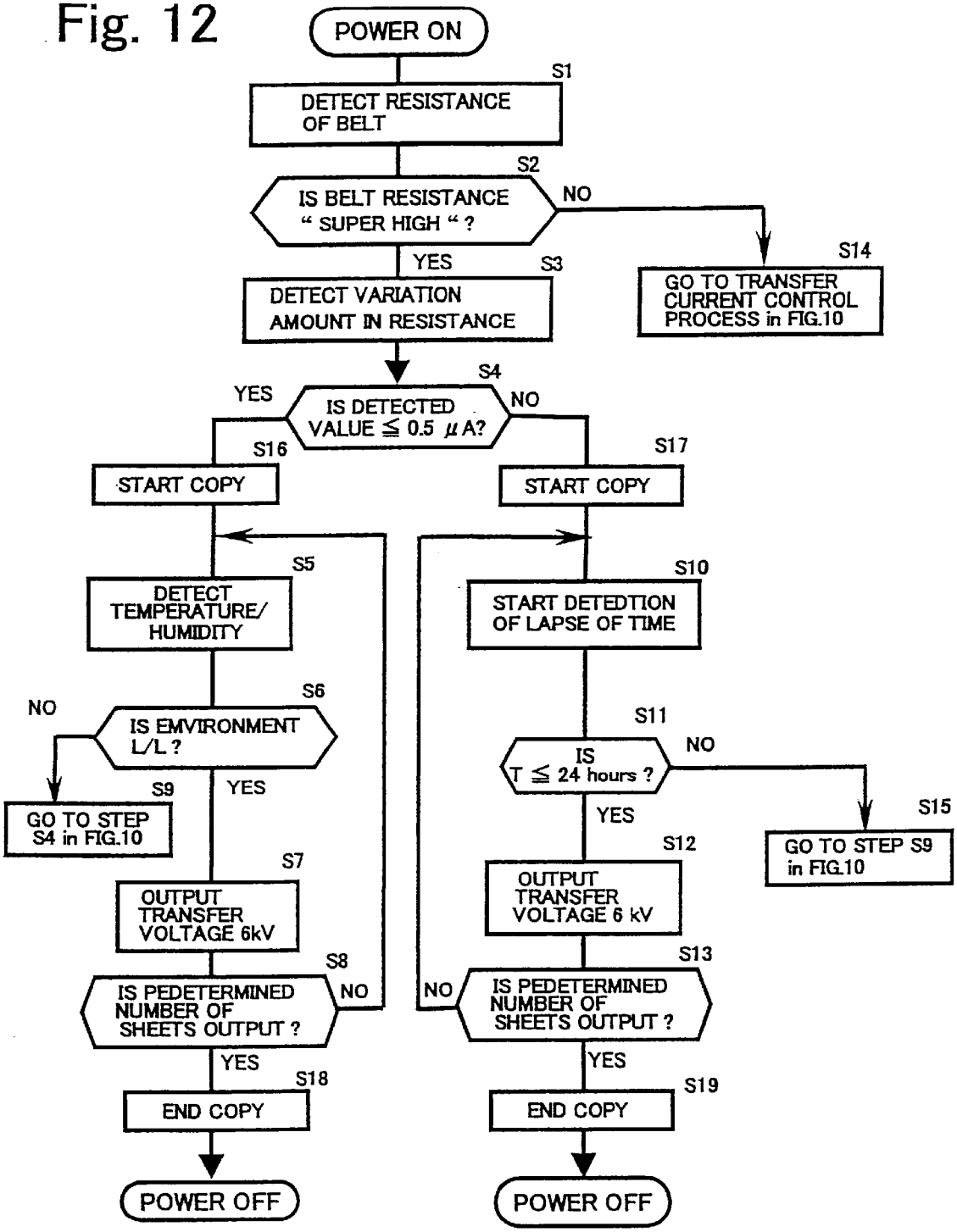
FIG. 12 is a flowchart illustrating a process of controlling a transfer current of another embodiment of the present invention.

FIG. 12 illustrates an example of an operation of switching from the differential constant current control system to the constant voltage control system.

In the flowchart in FIG. 12, the resistance of the transfer belt 6 is detected (Step Sl) and the controller 30 judges whether the detected resistance is "super high" (Step S2). When the resistance of the transfer belt 6 is not "super high" (NO, in Step S2), the controller 30 performs the transfer current control process in FIG. 10 (Step S14). When the resistance of the transfer belt 6 is judged to be "super high" (YES in Step S2), the controller 30 detects amount of variation in the resistance (current) of the transfer belt 6 (Step S3). Further, the controller 30 judges whether the amount of variation in the resistance is 0.5 $\mu$A or less (Step S4).

When the detected resistance (current) is 0.5 $\mu$A or less, the process proceeds to Step S16 where a copying operation is started. Then, the controller 30 detects the environmental condition (temperature and humidity) (Step S5) and judges whether the environmental condition is L/L (low temperature and low humidity)(Step S6). When the environmental condition is not L/L (No in Step S6), the process proceeds to Step S4 in the flowchart in FIG. 10 (Step S9) and the current control of the transfer bias of Step S4 and the following steps in the flowchart in FIG. 10 are performed. In addition, when the environmental condition is L/L (YES in Step S6), the control is switched to a constant voltage control system and the controller 30 outputs a transfer voltage of 6 kV (Step S7). Then, the transfer operation of the predetermined number of sheets is performed under the constant transfer voltage of 6 kV (Steps through S8, 5, 6, and 7), and when the number of output copied sheets reaches the predetermined number (YES in Step S8), the controller 30 ends the copying operation (Step S18).

On the other hand, when the amount of variation in the resistance (current) is more than 0.5 $\mu$A (NO in Step S4), the process proceeds to Step S17 where the copying operation is started. Then, a detection of lapse of time starts (Step S10), and the controller 30 judges whether the lapse of time has reached 24 hours (Step S11). When the lapse of time exceeds 24 hours (NO in Step S11), the process proceeds to Step S9 in the flowchart in FIG. 10 to perform the current control of the transfer bias according to the Step S9 and the following steps in the flowchart in FIG. 10 (Step S15). When the lapse of time does not exceed 24 hours the control is switched from the differential constant current control system to the constant voltage control system and the controller 30 outputs the transfer voltage of 6 kV (Step S12). Then, the predetermined number of transfer operation is performed under the constant output transfer voltage of 6 kV. When the predetermined number of sheet is output (YES in Step S13), the copying operation ends (Step S19).

Thus, in a transfer-conveyance device using a transfer belt made of either an ionic conductor or a carbon-dispersed conductor, when the transfer belt 6 has the resistance of "super high", the control can be switched from a differential constant current control system to the constant voltage control system is used.

Accordingly, regardless of the property of material of the transfer belt 6, a stable transfer bias control can be performed and particularly, the leakage from the transfer belt to the photoconductor drum caused by a high transfer voltage can be prevented.

The present invention is not limited to the above-described embodiments. For example, although a transfer belt 6 is employed in the transfer-conveyance device in the above-described embodiments, a transfer roller may be employed. Further, the present invention can be applied not only to a transfer-conveyance device using a differential constant current control system but also to a transfer-conveyance device using a constant current control system or a constant voltage control system. In addition, the present invention can be applied to a transfer-conveyance device using a transfer belt having the resistance of one or two digits larger than those of the transfer belt 6 illustrated in FIGS. 1 to 6. Furthermore, the driven roller 4 in the transfer-conveyance device illustrated in FIGS. 1 to 6 may be either grounded or floated. Also, the drive roller 5 may be either also grounded or floated.

Furthermore, as for the detecting method of detecting the amount of variation in the resistance of a transfer belt, either a method to detect an amount of variation in the current by detecting a current value for a predetermined time period while a certain constant voltage is being applied to the transfer belt 6, or another method to detect an amount of variation in the voltage by detecting a voltage value for a predetermined time period while a certain constant current is applied to the transfer belt 6. Also, the predetermined time period to apply the certain constant voltage is not limited to that in the above-described embodiment. Furthermore, a construction of the controller 30 to perform the control in the embodiments is not also limited to that illustrated in FIG. 8.

Obviously, numerous modifications and variations of the present invention are possible in light of the above teachings. It is therefore to be understood that within the scope of the appended claims, the invention may be practiced otherwise than as specifically described herein.

This document claims priority and contains subject matter related to Japanese Patent Applications No. 11-036393, filed on Feb. 15, 1999, and the entire contents thereof are herein incorporated by reference.

What is claimed as new and desired to be secured by Letters Patent of the United States is:

1. A transfer-conveyance device to transfer a visible image on an image bearing member in an image forming apparatus onto a transfer sheet and to convey the transfer sheet, comprising:

a contact member configured to contact the image bearing member;

a bias applying device configured to apply a transfer bias to the contact member;

a resistance detecting device configured to detect a resistance of the contact member over a period of time; and a transfer bias control device configured to determine an amount of variation in the resistance of the contact member and control the transfer bias, wherein the transfer bias is controlled on a basis of the amount of variation in the resistance of the contact member.

2. The transfer-conveyance device according to claim 1, wherein the contact member is a transfer belt.

3. The transfer-conveyance device according to claim 1, wherein the transfer bias is further controlled on a basis of the resistance of the contact member.

4. The transfer-conveyance device according to claim 3, wherein the contact member is a transfer belt.

5. The transfer-conveyance device according to claim 1, further comprising:

an environmental condition detecting device to detect an environmental condition, wherein the transfer bias is further controlled on a basis of the environmental condition.

6. The transfer-conveyance device according to claim 5, wherein the contact member is a transfer belt.

7. The transfer-conveyance device according to claim 5, wherein the transfer bias is further controlled on a basis of the resistance of the contact member.

8. The transfer-conveyance device according to claim 1, further comprising:

a device to determine a lapse of time, wherein the transfer bias is further controlled on a basis of the lapse of time.

9. The transfer-conveyance device according to claim 8, wherein the contact member is a transfer belt.

10. The transfer-conveyance device according to claim 8, wherein the transfer bias is further controlled on a basis of the resistance of the contact member.

11. The transfer-conveyance device according to claim 10, wherein the contact member is a transfer belt.

12. An image forming apparatus, comprising:

an image bearing member; and a transfer-conveyance device configured to transfer a visible image on an image bearing member onto a transfer sheet and to convey the transfer sheet, the transfer-conveyance device including:

a contact member contacting the image bearing member, a bias applying device configured to apply a transfer bias to the contact member, a resistance detecting device configured to detect a resistance of the contact member, and a transfer bias control device configured to determine an amount of variation in the resistance of the contact member over a period of time and control the transfer bias, wherein the transfer bias is controlled on a basis of the amount of variation in the resistance of the contact member.

13. A transfer-conveyance device for transferring a visible image on an image bearing member in an image forming apparatus onto a transfer sheet and to convey the transfer sheet, comprising:

means configured for contacting the image bearing member;

means for applying a transfer bias to the contacting means;

means for detecting a resistance of the contacting means; and means for determining an amount of variation in the resistance of the contacting means over a period of time and for controlling the transfer bias, wherein the transfer bias is controlled on a basis of the amount of variation in the resistance of the contacting means.

14. The transfer-conveyance device according to claim 13, wherein the transfer bias is further controlled on a basis of the resistance of the contacting means.

15. The transfer-conveyance device according to claim 13, further comprising:

means for detecting an environmental condition, wherein the transfer bias is further controlled on a basis of the environmental condition.

16. The transfer-conveyance device according to claim 15, wherein the transfer bias is further controlled on a basis of the resistance of the contacting means.

17. The transfer-conveyance device according to claim 13, further comprising:

means for determining a lapse of time, wherein the transfer bias is further controlled on a basis of the lapse of time.

18. The transfer-conveyance device according to claim 17, wherein the transfer bias is further controlled on a basis of the resistance of the contacting means.

19. A method of transferring a visible image on an image bearing member to a transfer sheet and conveying the transfer sheet in an image forming apparatus, comprising the steps of:

applying a transfer bias to a contact member contacting the image bearing member to transfer the image on the image bearing member onto the transfer sheet;

detecting a resistance of the contact member;

determining an amount of variation in the resistance of the contact member over a period of time; and controlling the transfer bias on a basis of the amount of variation in the resistance of the contact member.

20. The method of transferring a visible image according to claim 19, wherein the step of controlling the transfer bias further includes controlling the transfer bias on a basis of the resistance of the contact member.

21. The method of transferring a visible image according to claim 19, further comprising the step of:

detecting an environmental condition, wherein the step of controlling the transfer bias further includes controlling the transfer bias on a basis of the environmental condition.

22. The method of transferring a visible image according to claim 21, wherein the step of controlling the transfer bias further includes controlling the transfer bias on a basis of the resistance of the contact member.

23. The method of transferring a visible image according to claim 19, further comprising the step of:

determining a lapse of time, wherein the step of controlling the transfer bias further includes controlling the transfer bias on a basis of the lapse of time.

24. The method of transferring a visible image according to claim 23, wherein the step of controlling the transfer bias further includes controlling the transfer bias on a basis of the resistance of the contact member.

* * * * *